United States Patent [19]

Sugihara

[11] 4,100,737

[45] Jul. 18, 1978

[54] EXHAUST GAS PURIFYING SYSTEM EMPLOYING AN EXHAUST GAS FLOW CONTROLLER

[75] Inventor: Kunihiko Sugihara, Yokohama City, Japan

[73] Assignee: Nissan Motor Company, Limited, Japan

[21] Appl. No.: 674,832

[22] Filed: Apr. 7, 1976

[30] Foreign Application Priority Data

May 21, 1975 [JP] Japan ..... 50/60668

[51] Int. Cl.[2] ..... F02B 75/10

[52] U.S. Cl. ..... 60/292; 123/97 B

[58] Field of Search ..... 60/292; 123/97 B

[56] References Cited

U.S. PATENT DOCUMENTS

| | | | |
|---|---|---|---|
| 2,753,147 | 7/1956 | Welge | 123/97 B |
| 3,234,924 | 2/1966 | May | 60/292 |
| 3,368,345 | 2/1968 | Walker | 123/97 B |
| 3,406,515 | 10/1968 | Behrens | 60/292 |
| 3,523,418 | 8/1970 | Marsee | 60/292 |
| 3,838,670 | 10/1974 | King | 123/97 B |
| 3,896,913 | 7/1975 | Maruoka | 60/285 |

FOREIGN PATENT DOCUMENTS

| | | | |
|---|---|---|---|
| 1,179,765 | 10/1964 | Fed. Rep. of Germany | 123/97 B |

*Primary Examiner*—Douglas Hart

*Attorney, Agent, or Firm*—Robert E. Burns; Emmanuel J. Lobato; Bruce L. Adams

[57] ABSTRACT

A damper door is swingably disposed in an exhaust system downstream of an afterburning device to open or close the exhaust tube or pipe in response to movement of a throttle valve of an air-fuel mixture supply means such as a carburetor.

3 Claims, 3 Drawing Figures

EXHAUST GAS PURIFYING SYSTEM EMPLOYING AN EXHAUST GAS FLOW CONTROLLER

BACKGROUND OF THE INVENTION

The present invention relates in general to an exhaust gas purifying system of an internal combustion engine and more particularly to the system which retains the exhaust gases emitted from the engine for a prolonged period of time in an afterburning device so as to achieve complete combustion of harmful combustible compounds such as hydrocarbons (HC) and carbon monoxide (CO) contained in the exhaust gases during deceleration and/or idling operation of the engine.

Some modernized internal combustion engine vehicles are equipped with afterburning devices such as oxidizing catalytic converters and/or thermal reactors in the exhaust systems thereof in order to completely burn out the remaining harmful combustible compounds such as hydrocarbons and carbon monoxide in the exhaust gases exhausted from the engine before the exhaust gases are discharged into the open air.

Apart from this, it is recognized that the rapid deceleration and/or idling operation of a carburetor type internal combustion engine causes the engine to produce increased amounts of the harmful combustible compounds. This is because, under such conditions the throttle valve of the carburetor is almost closed thus reducing the air induction into the combustion chambers of the engine. Thus, the air-fuel mixture in the combustion chambers becomes extremely rich with incomplete burning resulting.

Usually, the amount of the harmful compounds emitted from the engine in the above-mentioned states is excessive and cannot be completely treated or burnt sufficently rapidly by the afterburning device in the exhaust system of the engine, thus some of the remaining harmful compounds are discharged into the atmosphere.

SUMMARY OF THE INVENTION

Therefore, the present invention contemplates provision of an improved and new exhaust gas purifying system which can obviate the drawbacks encountered in the prior art system as mentioned.

It is an object of the present invention to provide the exhaust gas purifying system which retains the exhaust gases emitted from an internal combustion engine in an afterburning device for a prolonged period of time so as to achieve complete combustion of the harmful combustible compounds in the exhaust gases.

It is another object of the present invention to provide the exhaust gas purifying system in which the above-mentioned exhaust gas retention is achieved when the engine encounters rapid deceleration and/or is maintained in an idling condition.

It is still another object of the present invention to provide the exhaust gas purifying system which comprises a valve member such as a damper door member swingably or otherwise mounted in an exhaust tube downstream of the afterburning device so as to open or close the passage of the exhaust tube in response to the operation of a throttle valve of air-fuel mixture supply means mounted in an intake system of the engine.

It is a further object of the present invention to provide the exhaust gas purifying system which has a valve member such as a damper door member swingably or otherwise disposed in the exhaust tube, the swingable movement of the damper door being response to the magnitude of vacuum created in an air-fuel passage of the intake system of the engine.

BRIEF DESCRIPTION OF THE DRAWINGS

The other objects and advantages of the present invention will become more apparent from the following detailed description when taken in conjunction with the accompanied drawings, in which:

Referring now to FIG. 1 of the drawings, there is schematically shown an exhaust gas purifying system of the first embodiment of the present invention generally designated by reference numeral 10 and accompanied with an internal combustion engine 12 to which it is attached.

Figure 1:
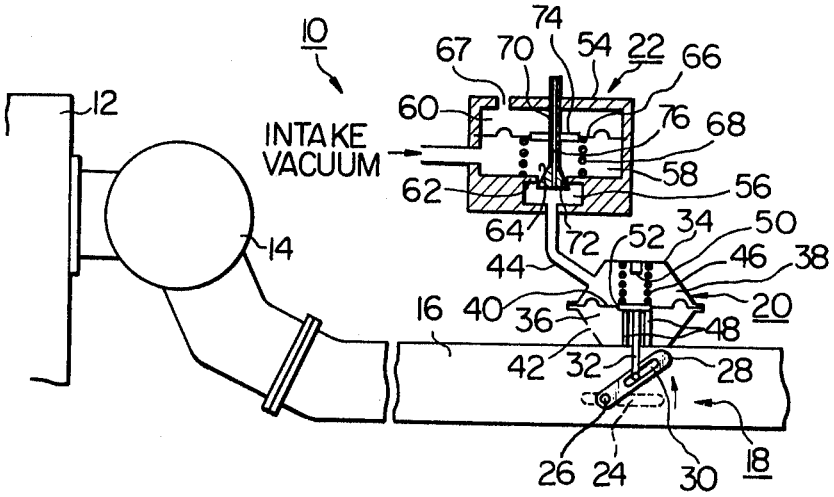
FIG. 1 is a sketch of an exhaust gas purifying system of the first preferred embodiment according to the present invention, the system being illustrated in combination with an internal combustion engine.

The exhaust system 10 generally comprises an afterburning device 14, an exhaust tube 16, a damper door mechanism 18, a damper door actuator 20 and an actuator controller 22.

The afterburning device 14 may be either a thermal reactor or an oxidizing catalyst converter.

The damper door mechanism 18 is mounted in the exhaust tube 16 downstream of the afterburning device 14 and comprises a damper door 24 having sufficient surface area to partially close the passage of the exhaust tube 16. The damper door 24 is pivotally supported for swinging movement relative to a section of the exhaust tube 16 by means of a conventional shaft 26. Firmly connected to the shaft 26 at its one end is an operating plate 28 which is swingable with the damper door 24 about the shaft 26. The operating plate 28 is formed at its other end portion thereof with an elongated opening 30 extending along the longitudinal direction thereof. Slidably engaged with the elongated opening 30 of the operating plate 28 is one end of a rod 32 which has the other end fixedly connected to a diaphragm member employed in the damper door actuator 20.

The damper door actuator 20 is positioned adjacent to the damper door mechanism 18 and comprises a casing 34 having a chamber divided into separate first and second chambers 36 and 38 by means of a diaphragm 40. The first chamber 36 is in communication with the atmosphere through an opening 42 formed in the casing 34, while the second chamber 38 is in communication with the actuator controller 22 through a conduit tube 44. Within the second chamber 38 is disposed a compression spring 46 which urges the diaphragm member 40 toward the first chamber 36. Further, within the first and second chambers 36 and 38, there are respectively provided stop members 48 and 50 which limit the downward and upward movements of the diaphragm member 40. As shown, the before-mentioned rod 32 of the damper door mechanism 18 is firmly connected at the other end thereof to the diaphragm member 40 through a protective plate or armature 52 fixed to the center of the diaphragm member 40. Now, it should be noted that the damper door 24 is so arranged to fully open the passage of the exhaust tube 16 when the diaphragm member 40 is in its rest position, as shown.

The actuator controller 22 comprises a casing 54 which has first, second and third chambers 56, 58 and 60 therein. As shown, the first and second chambers 56 and 58 are divided by a partition 62 formed in the casing 54 and are respectively fluidly in communication with the second chamber 38 of the damper door actuator 20 through the conduit tube 44, and the interior of an air-fuel mixture passage downstream of a throttle valve of air-fuel mixture supply means such as a carburetor (not shown). The partition 72 is formed at its generally central portion thereof with an opening 64 defining a valve seat. The second and the third chambers 58 and 60 are divided by a diaphragm member 66 which is urged toward the third chamber 60 by means of a compression spring 68 disposed in the second chamber 58. The third chamber 60 is in communication with the atmosphere through an opening 67 in the casing 54. A valve member 70 having at its one end a valve head 72 sealingly contactable with the opening 64 of the partition portion 62 is disposed within the casing 54 while connecting at a longitudinal middle portion thereof to the diaphragm member 66 through an armature 74. As shown, the valve member 70 has also therein an axially extending air passage 76 which is capable of providing limited fluid communication between the first chamber 56 and the atmosphere. Now, it should be noted that the actuator controller 22 allows the valve head 72 of the valve member 70 to open the opening 64 when the magnitude of the intake vacuum applied into the second chamber 58 reaches a predetermined level corresponding to the almost closed condition of the throttle valve.

With the above-stated constructions of the exhaust system 10 of the first embodiment, the operation thereof is made as follows:

Under engine operating conditions, when the throttle valve of the carburetor is fully closed due to the rapid deceleration of the engine and/or engine idling operation, the intake vacuum created in the air-fuel mixture passage downstream of the throttle valve rises to such a degree that the diaphragm member 66 of the actuator controller 22 is caused to flex or move toward the second chamber 58 from its home position against the urging force of the compression spring 68 with a result that the valve head 72 opens the opening 64. Thus, in this state, the intake vacuum is supplied into the second chamber 38 of the damper door actuator 20 through the conduit tube 44 to move the diaphragm member 40 and accordingly the rod 32 toward the second chamber 38. With this upward movement of the rod 32, the operating plate 28 is rotated counterclockwise about the shaft 26 thereby allowing the damper door 24 to close the passage of the exhaust tube 16. It is to be noted that the damper door closing angle is varied in accordance with the magnitude of the intake vacuum. Thus, by this movement of the damper door 24, the exhaust gases emitted from the engine 12 are retained in the afterburning device 14 for a prolonged period of time, so that the remaining harmful combustible compounds in the exhaust gases from the engine 12 are completely burnt out in the afterburning device 14.

Under this circumstance, when the throttle valve is open by an accelerating action to the engine, the vacuum created in the air-fuel passage downstream of the throttle valve is lowered to such a degree that the diaphragm member 66 of the controller 22 is caused to return to its rest position thereby allowing the valve head 72 of the valve member 70 to sealingly contact with the opening 64 of the partition portion 62. Thus, in this state, the vacuum supply into the second chamber 38 of the damper door actuator 20 is shut off and the diaphragm member 40 of the actuator 20 is allowed return to its home or rest position via air induction into the second chamber 38 through the air passage 76 of the valve member 70 and the conduit tube 44. The damper door 24 thus returns to the home or fully open position thereof as shown in the drawing.

Figure 2:
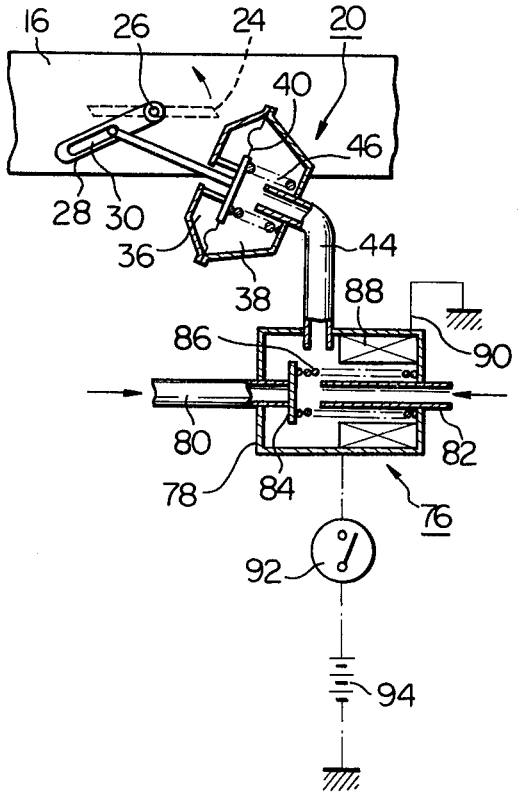
FIG. 2 is a sketch of an exhaust gas purifying system of the second preferred embodiment of the invention.

FIG. 2 schematically shows part of the exhaust gas purifying system 10 of a second preferred embodiment which comprises generally same parts as in the case of the first embodiment with the exception of the actuator controller 76.

In order to simplify the description, the parts having the same reference numerals as in FIG. 1 will not be fully described hereinafter.

The actuator controller 76 of this embodiment comprises a casing 78 into which the conduit tube 44 leading from the second chamber 38 of the damper door actuator 20 projects, as shown. Projecting into the casing 78 from both side ends thereof there are first and second conduit tubes 80 and 82 which are respectively in communication with an interior of the air-fuel mixture passage downstream of the throttle valve of the carburetor and the atmosphere. A flat valve member 84 made of a magnetic material is movably disposed in the casing 78 so as to selectively open or close the openings of the respective tubes 80 and 82. A compression spring 86 is disposed around the second conduit tube 82 in the casing 78 to bias the flat valve member 84 to close the opening of the first tube 80. A solenoid coil 88 is mounted around the compression spring 86 in the casing 78. The solenoid coil 88 has one terminal or lead wire 90 grounded and the other connected through a switch 92 to an electric power source 94, as shown. The switch 92 is a throttle valve switch which is constructed to close the circuit between the solenoid coil 88 and the electric power source 94 when the throttle valve is almost closed.

When, in operation, the switch 92 is closed due to almost closing of the throttle valve, the solenoid coil 88 is energized to attract the flat valve member 84 into a position wherein the opening of the first conduit tube 80 is open and the opening of the second conduit tube 82 is closed. Therefore, the vacuum created in the air-fuel mixture passage of the carburetor is supplied into the second chamber 38 of the damper door actuator 20 through the conduit tube 44 thereby allowing the diaphragm 40 to move toward the second chamber 38 while rotating the damper door 24 in a direction to close the passage of the exhaust tube 16. Accordingly, the exhaust gases emitted from the engine are retained in the afterburning device for a prolonged period of time for complete combustion thereof.

When, under this condition, the switch 92 is open due to the opening of the throttle valve, the solenoid coil 88 is de-energized thereby allowing the flat valve member 84 to take a position thereof, as shown in the drawing, wherein the opening of the first conduit tube 80 is closed and simultaneously the opening of the second tube 82 is open. Thus, air is supplied into the second chamber 38 of the damper door actuator 20 through the second conduit tube 82 from the atmosphere for returning the diaphragm member 40 back to its home or rest position by the assistance of the urging force of the compression spring 46. Consequently, the damper door 24 is returned to its rest position thereof wherein the passage of the exhaust tube 16 is fully open.

Figure 3:
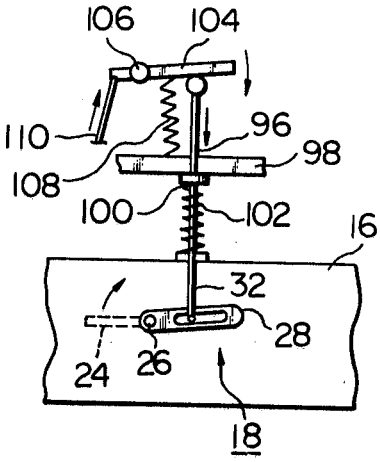
FIG. 3 is a sketch of an exhaust gas purifying system of the third preferred embodiment, according to the present invention.

FIG. 3 shows part of the exhaust system of a third embodiment according to the present invention, which comprises a damper door mechanism 18 consisting of the generally same parts of that of the first and second embodiments. In this embodiment, however, the generally middle portion of the rod 32 is clearly passed through an opening 96 formed in a stationary support member 98, as shown. Connected to the rod 32 at a position between the stationary support member 98 and the exhaust tube 16 is a stop 100. Between the stopper or stop 100 and the exhaust tube 16 and around the rod 32 is disposed a compression spring 102 which biases the stop 100 upwardly into contact with the stationary support member 98 for keeping the damper door in a position whereby the passage of the exhaust tube 16 is fully open, as shown. A lever 104 is pivotally supported for swinging movement by a shaft 106 and has a right side section contactable with a top end portion of the rod 32. A tension spring 108 is disposed between the right side section of the lever 104 and the stationary support member 98 for allowing the lever 104 to urge the rod 32 downwardly (as seen in the drawing). Connected to a left side section of the lever 104 is an end of a wire 110 leading from a throttle valve (not shown). It is to be noted that the lever 104 is arranged to push down at the right side section thereof the top end portion of the rod 32 only when the throttle valve is fully closed. If desired, the other end of the wire 110 may be connected to an accelerator pedal in such a manner that only when the pedal is kept in its home or release position, the lever 104 pushes down the rod 32.

When, in operation, the throttle valve is almost closed to allow the lever 104 to rotate clockwise with the assistance of force of the tension spring 108, the right side section of the lever 104 pushes the top end portion of the rod 32 down against the force of the compression spring 102. Therefore, in this instance, the damper door 24 is rotated clockwise to partially close the passage of the exhaust tube 16 to retain the exhaust gases from the engine 12 in the after-burning device 14 for a prolonged period of time for achieving the complete combustion thereof.

When the throttle valve is open, the lever 104 is rotated counterclockwise about the shaft 106 while disengaging from the top end portion of the rod 32, thus the rod 32 moves upwardly until the stop 100 contacts the stationary support member 98. Thus, in this case, the damper door 24 returns to the rest or fully open position thereof as shown in the drawing.

In conclusion, with the above-stated exhaust gas purifying system of the present invention, the exhaust gases emitted from the internal combustion engine are retained in the afterburing device for a prolonged period of time for achieving complete combustion thereof when the engine unergoes a rapid deceleration and/or is maintained in an idling state.

It is to be noted that the invention is not to be limited to the exact construction shown and described and that various changes and modifications may be made without departing from the spirit and scope of the invention, as defined in the appended claims.

What is claimed is:

1. An exhaust gas purifying system for use with an internal combustion engine having an intake conduit system and an exhaust conduit system, said intake conduit system including an air-fuel mixture supply means having an air-fuel mixture passage downstream of a throttle valve, said exhaust gas purifying system comprising: an afterburning device disposed in use in said exhaust conduit of said internal combustion engine, said afterburning device comprising an oxidizing catalyst converter or a thermal reactor; a damper door swingably disposed in said exhaust conduit downstream of said afterburning device for partially closing and fully opening a discharge passage of said exhaust conduit; a damper door actuator having therein a moveable member actuated in response to application of a vacuum to said actuator; linkage means for transmitting the movements of said moveable member to said damper door to rotate said damper door in a direction to partially close the passage of said exhaust conduit system when a vacuum is applied to said actuator; a solenoid valve having a first casing, a tube providing communication between the casing and the interior of said damper door actuator; first and second tubes projecting into said first casing from opposite sides of said casing and having open ends facing each other in said first casing, said first and second tubes being in communication with the interior of an air-fuel mixture passage in the internal combustion engine and the atmosphere, respectively; a valve member of magnetic material moveable between the open ends of said first and second tubes to selectively and alternatively close the same; a compression spring disposed in said first casing continuously biasing said valve member in a direction to close the open end of said first tube; a solenoid coil disposed in said first casing attracting said valve member when energized to move it to close the open end of said second tube; and a throttle valve switch electrically connected to said solenoid coil to control energization of said coil when the throttle valve of said intake conduit system almost closes said air-fuel mixture passage.

2. An exhaust gas purifying system as claimed in claim 1, in which said linkage means comprises: a shaft fixed to said damper door for rotation therewith; an operating plate connected at its one end to said shaft for rotation therewith and having a longitudinally extending elongated opening at a portion thereof other than said one end; and a rod having on end slidably engaged with said elongated opening of said operating plate and another end connected to said moveable member of said damper door actuator.

3. An exhaust gas purifying system as claimed in claim 1, in which said damper door actuator comprises a second casing; said moveable member constituting a diaphragm disposed in said second casing to divide the same into a first chamber and a second chamber, said first chamber being in communication with the atmosphere and said second chamber fluidly communicating with the interior of said first casing; a compression spring disposed in said second chamber urging said diaphragm member toward said first chamber; and stop members disposed in said first and second chambers for limiting reciprocating movements of said diaphragm.

* * * * *